US009483972B2

(12) United States Patent
Yoshinaga

(10) Patent No.: US 9,483,972 B2
(45) Date of Patent: Nov. 1, 2016

(54) DISPLAY DEVICE, DISPLAY METHOD, AND ELECTRONIC SYSTEM

(75) Inventor: Tomoro Yoshinaga, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 246 days.

(21) Appl. No.: 13/606,995

(22) Filed: Sep. 7, 2012

(65) Prior Publication Data

US 2013/0076801 A1 Mar. 28, 2013

(30) Foreign Application Priority Data

Sep. 22, 2011 (JP) ..... 2011-207140

(51) Int. Cl.
*G09F 3/20* (2006.01)
*G09G 3/20* (2006.01)

(52) U.S. Cl.
CPC ..... *G09G 3/2033* (2013.01); *G09G 2310/08* (2013.01); *G09G 2320/0266* (2013.01); *G09G 2320/0271* (2013.01)

(58) Field of Classification Search
CPC ..... G09G 2320/0266; G09G 3/2033
See application file for complete search history.

(56) References Cited

U.S. PATENT DOCUMENTS

2006/0284903 A1* 12/2006 Ng ..... 345/691
2007/0064019 A1* 3/2007 Thebault et al. ..... 345/691
2008/0055206 A1* 3/2008 Ryu et al. ..... 345/76
2008/0158262 A1* 7/2008 Russell et al. ..... 345/690
2008/0259019 A1* 10/2008 Ng ..... 345/98
2010/0053223 A1* 3/2010 Otsuka ..... G09G 3/2022 345/690
2011/0248979 A1* 10/2011 Nishimura ..... 345/211

FOREIGN PATENT DOCUMENTS

| | | |
|---|---|---|
| JP | HEI 09-218662 | 8/1997 |
| JP | HEI 10-171400 | 6/1998 |
| JP | HEI 11-052912 | 2/1999 |
| JP | HEI 11-109916 | 4/1999 |
| JP | 2002-351431 | 12/2002 |
| JP | 2006-343609 | 12/2006 |

OTHER PUBLICATIONS

Japanese Office Examination Report issued in connection with related Japanese Patent Application No. JP 2011-207140 dated May 26, 2015 with English translation.
Japanese Office Examination Report issued in connection with related Japanese Patent Application No. JP 2011-207140 dated Nov. 4, 2015.

* cited by examiner

*Primary Examiner* — Dwayne Bost
*Assistant Examiner* — Maheen Javed
(74) *Attorney, Agent, or Firm* — Dentons US LLP

(57) ABSTRACT

A display method includes: performing display by driving a display pixel at a drive interval that conforms to a weight of each bit in a gray-scale code that includes the bits; and so correcting the drive interval, the gray-scale code, or both of the drive interval and the gray-scale code as to change a luminance of the display pixel smoothly.

12 Claims, 14 Drawing Sheets

T

| INPUT | OUTPUT |
|---|---|
| ⋮ | ⋮ |
| 2045 | 2045 |
| 2046 | 2046 |
| 2047 | 2047 |
| 2048 | 2077 |
| 2048 | 2078 |
| 2049 | 2079 |
| ⋮ | ⋮ |

T

| INPUT | OUTPUT |
|---|---|
| ⋮ | ⋮ |
| 1021 | 1021 |
| 1022 | 1022 |
| 1023 | 1023 |
| 1024 | 1051 |
| 1025 | 1052 |
| 1026 | 1053 |
| ⋮ | ⋮ |

DISPLAY DEVICE, DISPLAY METHOD, AND ELECTRONIC SYSTEM

BACKGROUND

The present disclosure relates to a display device that performs gray-scale display with pulse width modulation, a display method used in such a display device as mentioned above, and an electronic system that includes such a display device as mentioned above.

Display devices are loaded on various types of electronic system nowadays. Various types of display devices such as liquid crystal display devices, plasma display devices, organic EL (Electro Luminescence) display devices and the like are developed from the view point of image quality, power consumption, and the like and are applied to various types of electronic system such as stationary television sets, cell phones, personal digital assistants and the like in accordance with their characteristics.

As a method of driving a display device, an analog drive system and a digital drive system are available. For example, the analog drive system is adapted to supply an analog pixel voltage to each pixel and is often used in the liquid crystal display devices, the organic EL display devices and the like. The digital drive system is adapted to supply a digital signal which has been subjected to, for example, pulse width modulation (PWM) to each pixel. For example, Japanese Unexamined Patent Application Publication No. 2006-343609 discloses a display device of the digital drive system that a drive voltage corresponding to each bit is supplied to each pixel at a time interval (a subfield period) conforming to the weight of each bit of display data (a code), to control on-off operation of an electro-optical device of the pixel, thereby performing display.

SUMMARY

Incidentally, in general, it is desirable that a display device be high in image quality. Although each pixel performs display with a luminance conforming to a mean value of time of the waveform of a digital signal applied thereto in the display device of the digital drive system, it may sometimes occur that the luminance of the pixel does not smoothly change with changing a code value of the digital signal. In the above mentioned case, since it is difficult to normally perform gray-scale display, the image quality may be reduced.

It is desirable to provide a display device, a display method, and an electronic system that are allowed to increase the image quality.

A display device according to an embodiment of the present disclosure includes: a display section including a display pixel; a driving section driving, at a drive interval that conforms to a weight of each bit in a gray-scale code that includes the bits, the display pixel based on a value of each of the bits; and a correcting section configured to so correct the drive interval, the gray-scale code, or both of the drive interval and the gray-scale code as to change a luminance of the display pixel smoothly.

A display method according to an embodiment of the present disclosure includes: performing display by driving a display pixel at a drive interval that conforms to a weight of each bit in a gray-scale code that includes the bits; and so correcting the drive interval, the gray-scale code, or both of the drive interval and the gray-scale code as to change a luminance of the display pixel smoothly.

An electronic system according to an embodiment of the present disclosure includes: a display device; and a control section performing operation control that utilizes the display device. The display device includes a display section including a display pixel, a driving section driving, at a drive interval that conforms to a weight of each bit in a gray-scale code that includes the bits, the display pixel based on a value of each of the bits, and a correcting section configured to so correct the drive interval, the gray-scale code, or both of the drive interval and the gray-scale code as to change a luminance of the display pixel smoothly.

The electronic system can be, for example but not limited to, a television set, a digital camera, a personal computer, a video camera, a portable terminal such as a cell phone, and a projector.

In the display device, the display method, and the electronic system according to the embodiments of the present disclosure, the display pixel is driven on the basis of the value of each of the bits at the drive interval conforming to the weight of each of the bits in the gray-scale code. In the above mentioned case, the drive interval or the gray-scale code or both is/are corrected such that the luminance of the display pixel smoothly changes.

According to the display device, the display method, and the electronic system of the embodiments of the present disclosure, since the drive interval or the gray-scale code or both is/are corrected, the image quality is increased.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Next, preferred embodiments of the present disclosure will be described in detail with reference to the accompanying drawings. It is to be noted that description will be made in the following order.

1. Preferred Embodiments
2. Application Examples

<1. Preferred Embodiments>

[Configuration Example]

(General Configuration Example)

Figure 1:
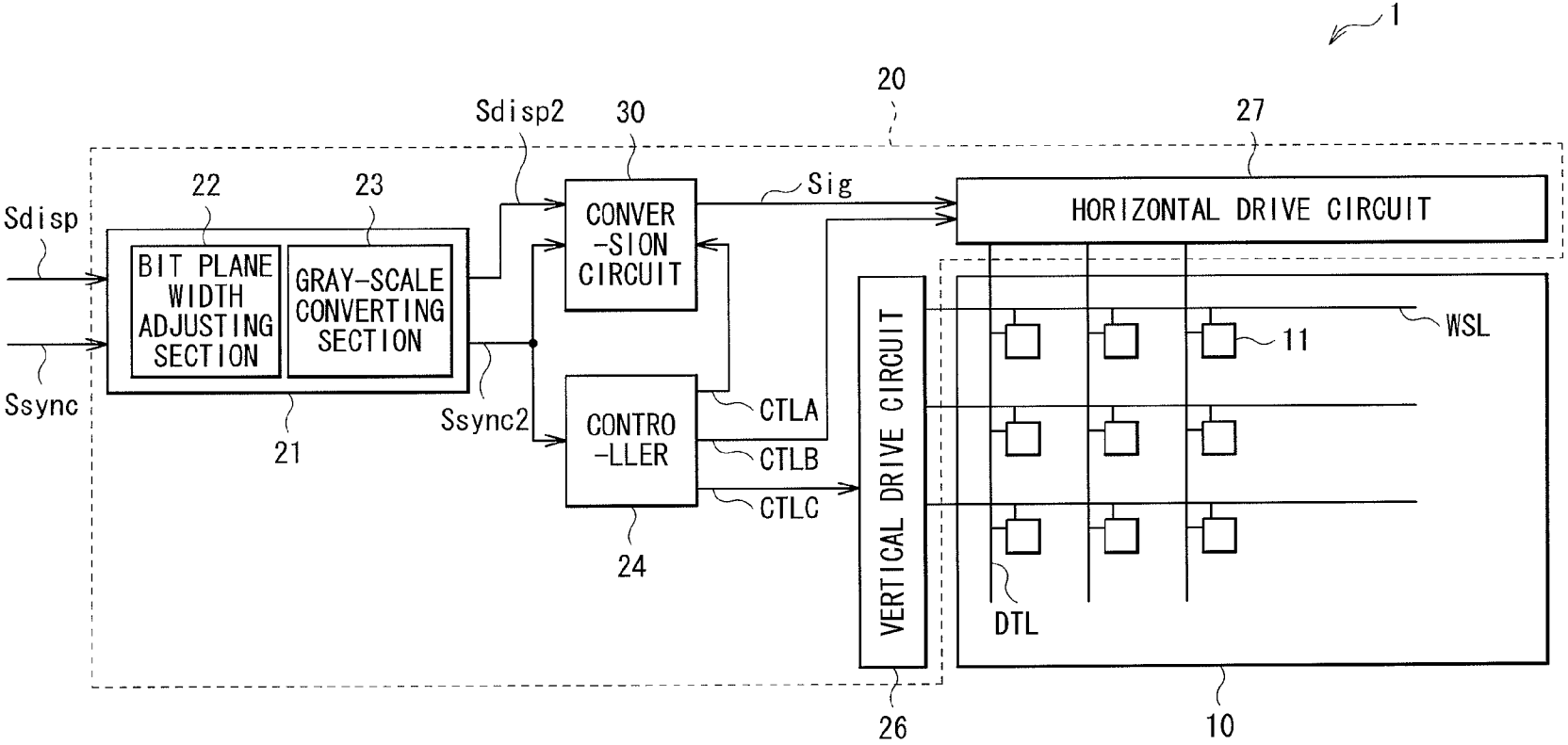
FIG. 1 is a block diagram illustrating one configuration example of a display device according to an embodiment of the present disclosure.

FIG. 1 illustrates a configuration example of the display device according to a first embodiment. The display device 1 is a display device of the digital drive system that performs gray-scale display with pulse width modulation. It is to be noted that since a display method according to an embodiment of the present disclosure is embodied by the present embodiment, it will be described together. The display device 1 includes a display panel 10 and a peripheral circuit 20.

The display panel 10 is of the type that a plurality of pixels 11 are arranged in a matrix. The pixel 11 corresponds to a minimum unit point configuring a display screen on the display panel 10. When the display panel 10 is a color display panel, the pixel 11 corresponds to a sub-pixel that emits light of a single color such as, for example, red, green, yellow, or the like. When the display panel 10 is a monochromatic display panel, the pixel 11 corresponds to a pixel that emits single-colored light (for example, white light).

Although not illustrated in the drawing, the pixel 11 is a memory built-in type pixel that includes an electro-optical device, in this example. Examples of the electro-optical device include a liquid crystal cell, an organic EL (Electro Luminescence) cell, and the like. Examples of the memory include an SRAM (Static Random Access Memory), a DRAM (Dynamic Random Access Memory), and the like.

The display panel 10 includes a plurality of scan lines WSLs extending in a row direction and a plurality of data lines DTLs extending in a column direction. One ends of these scan lines WSLs and data lines DTLs are connected to the peripheral circuit 20. Each of the above mentioned pixels 11 is arranged on a place where the scan line WSL and the data line DTL mutually intersect.

Owing to the above mentioned configuration, a value of each bit in the gray-scale code is written into the pixel 11 via the data line DTL a plurality of times in a period corresponding to a one-frame period (1F) as described later. The value of each bit corresponds to a light-emitted state or a light-extinguished state. Then, the pixel 11 maintains the state (the light-emitted state or the light-extinguished state) for a time taken until next value writing is performed. Owing to the above, the pixel performs gray-scale display in accordance with a change in ratio of a period during which it is in the light-emitted state (a light-emitted period) or a period during which it is in the light-extinguished state (a light-extinguished period) in the one-frame period. That is, the pixel 11 performs gray-scale display with pulse width modulation.

The peripheral circuit 20 is a circuit that drives the display panel 10 on the basis of an image signal $S_{disp}$ and a synchronous signal $S_{sync}$ supplied thereto. In this example, the image signal $S_{disp}$ includes a 4096-step gray-scale code that includes respective pieces of 12-bit gray-scale data c1 (LSB) to c12 (MSB). Examples of the synchronous signal $S_{sync}$ include a vertical synchronous signal, a horizontal synchronous signal, a dot clock signal and the like.

The peripheral circuit 20 includes a gray-scale correction circuit 21, a controller 24, a conversion circuit 30, a vertical drive circuit 26, and a horizontal drive circuit 27.

The gray-scale correction circuit 21 corrects gray-scale display on the display panel 10. The gray-scale correction circuit 21 includes a bit plane width adjusting section 22, and a gray-scale converting section 23.

The bit plane width adjusting section 22 adjusts a time width of a period (a bit plane BP) during which the pixel 11 maintains a state corresponding to each bit of the gray-scale data as described later. In the above mentioned case, the bit plane width adjusting section 22 divides the bit plane BP corresponding to the most significant bit (MSB) of the gray-scale data into two bit planes and adjusts the time width of each divided bit plane BP in this example. In addition, the bit plane width adjusting section 22 also has a function of format-converting the 4096-step gray-scale code C that includes the respective pieces of 12-bit gray-scale data b1 to b12 into a 4096-step gray-scale code B which includes respective pieces of 13-bit gray-scale data b1 to b13 and is the same as the code C in step number as described later.

The gray-scale converting section 23 performs gray-scale conversion so as to exclude partial gray-scale data in the gray-scale code B as described later. The gray-scale converting section 23 performs the gray-scale conversion by using, for example, a conversion table T.

In the gray-scale correction circuit 21, the bit plane width adjusting section 22 and the gray-scale converting section 23 perform the above mentioned processing on the basis of the image signal $S_{disp}$ and the synchronous signal $S_{sync}$. Then, the gray-scale correction circuit 21 generates an image signal $S_{disp}$2 and a synchronous signal $S_{sync}$2 on the basis of a processed result. Here, the image signal $S_{disp}$2 includes the gray-scale code B so gray-scale-converted by the gray-scale converting section 23 and the synchronous signal $S_{sync}$2 includes information on the time width and the like of each bit plane BP so adjusted by the bit plane width adjusting section 22.

The controller 24 is a circuit that supplies respective control signals to the conversion circuit 30, the horizontal drive circuit 27, and the vertical drive circuit 26 on the basis of the synchronous signal $S_{disp}$2 supplied from the gray-scale correction circuit 21 and controls such that these circuits operate in synchronization with one another. Specifically, the controller 24 supplies a control signal CTLA to the conversion circuit 30, supplies a control signal CTLB to the horizontal drive circuit 27, and supplies a control signal CTLC to the vertical drive circuit 26. Examples of the control signals CTLA, CTLB, and CTLC include clock signals, latch signals, frame start signals, and the like.

The conversion circuit 30 is a circuit that converts the image signal $S_{disp}$2 that synchronizes with the synchronous signal $S_{sync}$2 into an image signal $S_{ig}$ suited for driving the display panel 10.

Figure 2:
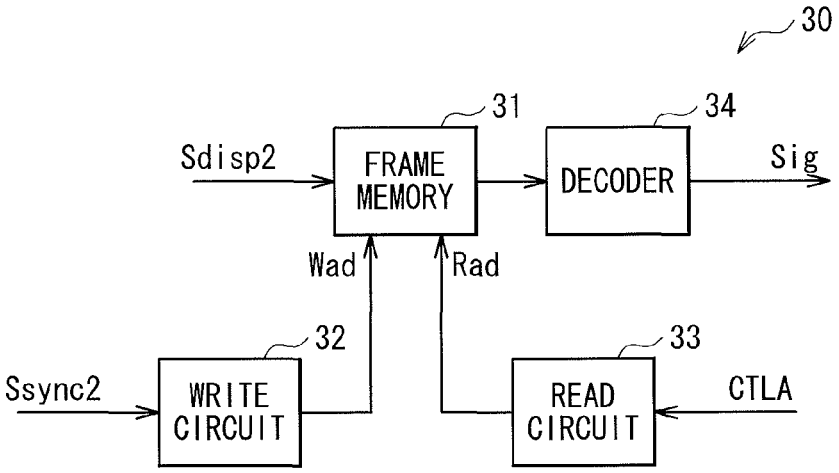
FIG. 2 is a block diagram illustrating one configuration example of a conversion circuit illustrated in FIG. 1.

FIG. 2 illustrates one configuration example of the conversion circuit 30. The conversion circuit 30 includes a frame memory 31, a write circuit 32, a read circuit 33, and a decoder 34. The frame memory 31 is a memory for image display having a storage capacity preferably exceeding the resolution of the display panel 10 and stores, for example, a row address, a column address, and each piece of gray-scale data of the gray-scale code B of each pixel 11 related to the row address and the column address. The write circuit 32 generates a write address $W_{ad}$ of the gray-scale data for the frame memory 31 on the basis of the synchronous signal $S_{sync}$2, and outputs the write address $W_{ad}$ to the frame memory 31 in synchronization with the synchronous signal $S_{sync}$2. The write address $W_{ad}$ includes, for example, the row address and the column address. The read circuit 33 generates a read address $R_{ad}$ on the basis of the control signal CTLA and outputs it to the frame memory 31. The decoder 34 outputs the gray-scale data output from the frame memory 31 as the signal data (the image signal) $S_{ig}$.

The vertical drive circuit 26 has a function of generating a scan line signal WS that includes a scanning pulse used for selecting each pixel 11 in units of rows on the basis of address data which is specified from the control signal CTLC, and outputting it to the scan line WSL. The horizontal drive circuit 27 generates a data line signal DT that includes the gray-scale data of each pixel 11 on the basis of the control signal CTLB and the signal data $S_{ig}$, and outputs it to the data line DTL.

Owing to the above mentioned configuration, in the peripheral circuit 20, the vertical drive circuit 26 selects the same pixel 11 a plurality of times each time in the one-frame period (1F), and the horizontal drive circuit 27 writes the value of each bit of the gray-scale data into the selected pixel 11 as described later. Owing to the above, the peripheral circuit 20 stepwise controls the ratio of the light-emitted period or the light-extinguished period in the one-frame period (F1) of each pixel 11.

Here, the vertical drive circuit 26 and the horizontal drive circuit 27 correspond to one specific but not limitative example of the "driving section" in one embodiment of the present disclosure. The gray-scale correction circuit 21 corresponds to one specific but not limitative example of the "correcting section" in one embodiment of the present disclosure. The bit plane BP corresponds to one specific but not limitative example of the "drive interval" in one embodiment of the present disclosure.

[Operation and Effect]

Next, operation and effect of the display device 1 according to the present embodiment will be described.

(Outline of General Operation)

First, the outline of general operation of the display device 1 will be described with reference to FIG. 1. The gray-scale correction circuit 21 corrects gray-scale display on the display panel 10 on the basis of the image signal $S_{disp}$ and the synchronous signal $S_{sync}$, and generates the image signal $S_{disp}$2 and the synchronous signal $S_{sync}$2. Specifically, in the gray-scale correction circuit 21, the bit plane width adjusting section 22 divides the bit plane BP corresponding to the most significant bit of the gray-scale data into two bit planes, adjusts the time width of each divided bit plane BP, and format-converts the 12-bit gray-scale code C into the 13-bit gray-scale code B. Then, the gray-scale converting section 23 performs gray-scale conversion so as to exclude the partial gray-scale data in the gray-scale code B. The controller 24 generates the respective control signals CTLA, CTLB, and CTLC for controlling the operation timings of the conversion circuit 30, the horizontal drive circuit 27, and the vertical drive circuit 26, on the basis of the synchronous signal $S_{sync}$2. The conversion circuit 30 converts the image signal $S_{disp}$2 that synchronizes with the synchronous signal $S_{sync}$2 into the image signal $S_{ig}$. The vertical drive circuit 26 generates the scan line signal WS on the basis of the control signal CTLC. The horizontal drive circuit 27 generates the data line signal DT on the basis of the control signal CTLB and the signal data $S_{ig}$. Each pixel 11 of the display panel 10 performs gray-scale display with pulse width modulation on the basis of the data line signal DT and the scan line signal WS.

(Detailed Operation)

Next, the detailed operation of the display device 1 will be described.

Figure 3:
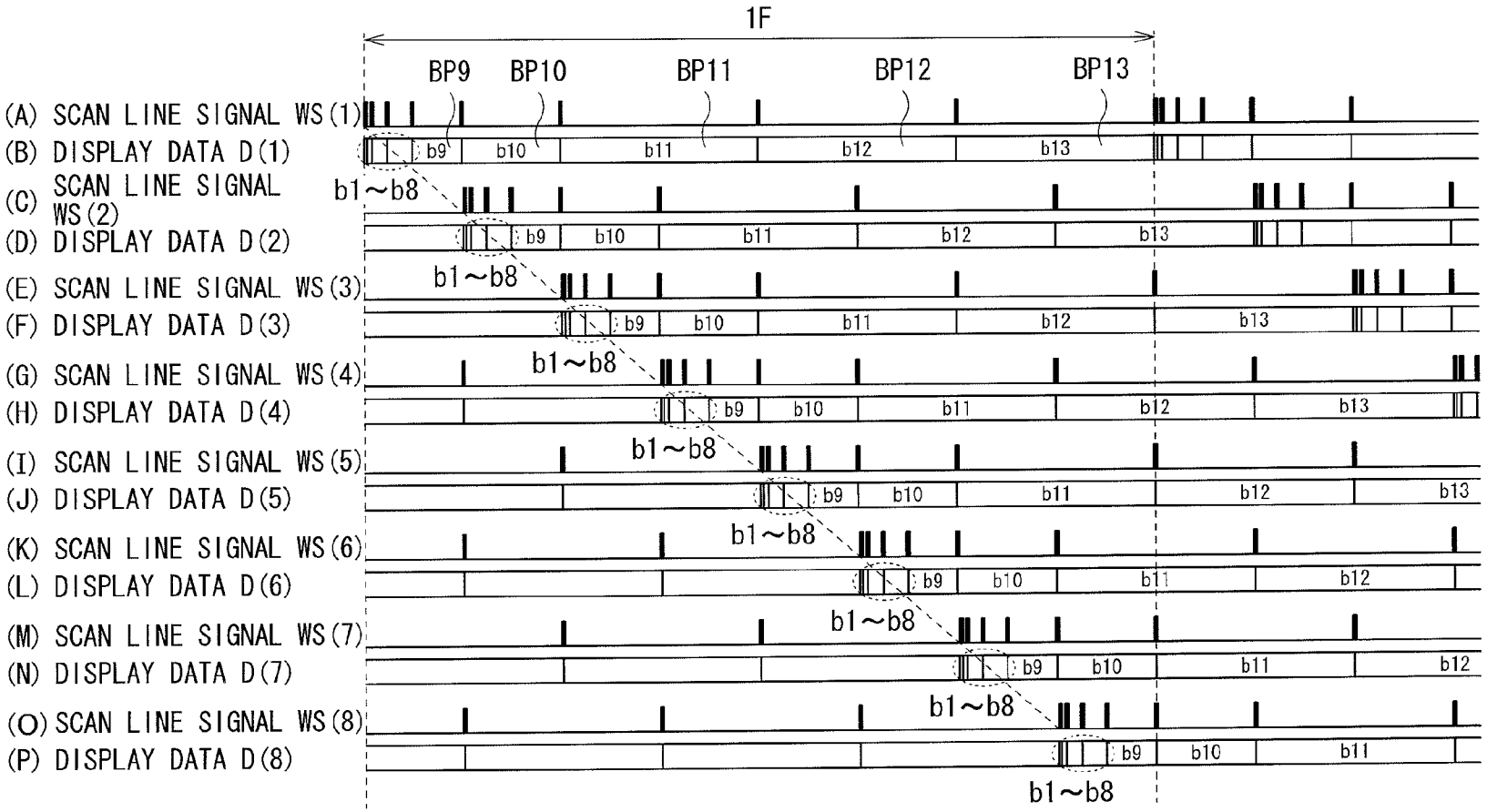
FIG. 3 is a schematic diagram illustrating an operational example of the display device illustrated in FIG. 1.

FIG. 3 schematically illustrates one example of a displaying operation performed by the display device 1. This example illustrates a case in which eight scan lines WSLs are prepared for the convenience of description. In FIGS. 3, (A), (C), (E), (G), (I), (K), (M), and (0) respectively indicate eight scan line signals WS(1) to WS(8), and (B), (D), (F), (H), (J), (L), (N), and (P) respectively indicate display data of the pixels 11 (1) to (8) of eight rows.

In the display device 1, the vertical drive circuit 26 outputs a plurality of scan pulses as the scan line signal WS (for example, the scan line signal WS (1) in (A) of FIG. 3) in the one-frame period (1F), and the horizontal drive circuit 27 outputs the respective bits b1 to b13 of the gray-scale code B at the timings of the above scan pulses, by which the pixel 11 displays data (for example, display data D (1) in (B) of FIG. 3) conforming to the gray-scale code B (the gray-scale data b1 to b13). Specifically, for example, the pixel 11 emits light when the value of the bit concerned is "1", and extinguishes light when the value of the bit concerned is "0". That is, the pixel 11 performs gray-scale display in accordance with a change in the ratio of the light-emitted period or the light-extinguished period in the one-frame period. It is to be noted that in the display device 1, the vertical drive circuit 26 is configured not to apply the scan pulses to mutually different rows together. Owing to the above, the pixels 11 in each row are allowed to perform display independently of one another.

In the display device 1, the time width of the period during which display of each of the bits b1 to b13 in the gray-scale code B is performed depends on each bit as illustrated in FIG. 3. That is, the time widths of the bit planes BP1 to BP11 relating to the respective pieces of gray-scale data b1 to b11 are set at the ratio of 1 (BP1):2 (BP2):4 (BP3):8 (BP4): . . . :512 (BP10):1024 (BP11) in accordance with the weights of the respective bits. In addition, the time widths of the bit planes BP12 and BP13 are set to the same extent as that of the time width of the bit plane BP11.

It is allowed to directly drive the pixels 11 on the basis of the respective bits b1 to b13 of the gray-scale code B by weighting the time widths of the bit planes BP1 to BP13 in each period.

The gray-scale code B is format-converted from the 12-bit gray-scale code C by the bit plane width adjusting section 22. Next, a process of format-converting the gray-scale code performed by the bit plane width adjusting section 22 will be described.

Figure 4A:
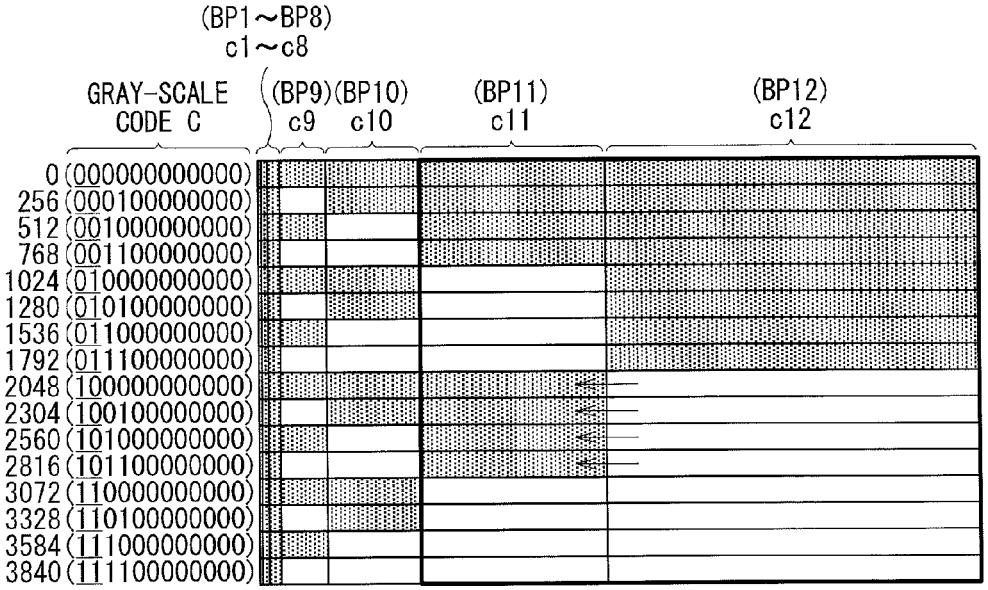
FIG. 4A and FIG. 4B are schematic diagrams illustrating examples of gray-scale codes relating to the display device illustrated in FIG. 1.
Figure 4B:
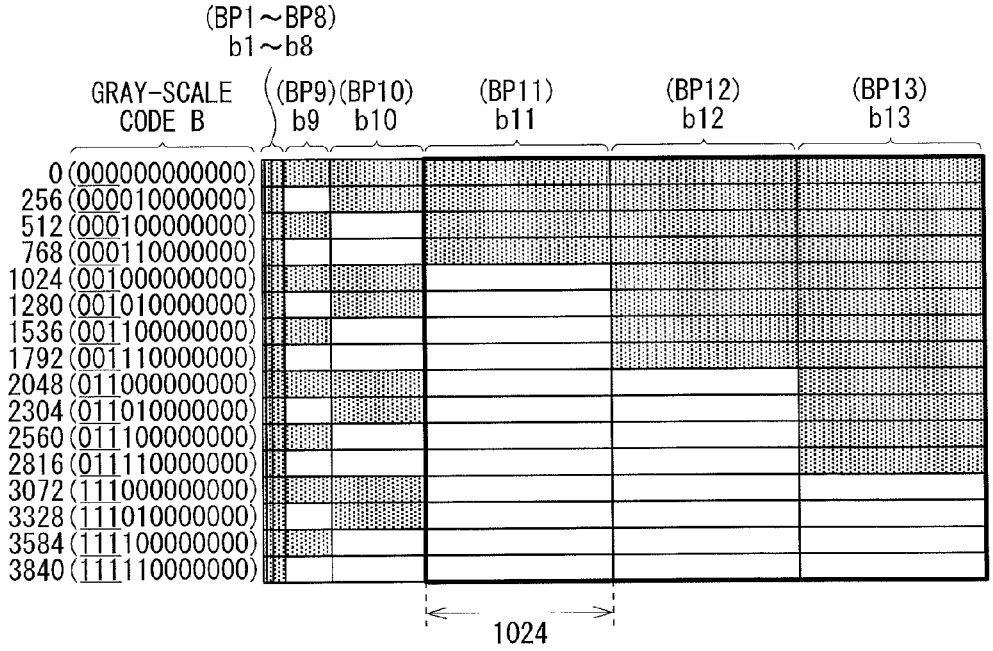

FIG. 4A and FIG. 4B illustrate examples of the gray-scale codes, in which FIG. 4A illustrates an example of the 12-bit gray-scale code C and FIG. 4B illustrates an example of the 13-bit gray-scale code B. In FIG. 4A and FIG. 4B, left-side diagrams respectively illustrate code examples of the gray-scale codes C and B and right-side diagrams schematically illustrate the code examples together with widths conforming to the weights of the respective bits. That is, the right-side diagrams in FIG. 4A and FIG. 4B correspond to the arrangement and the gray-scale data of the bit planes BP illustrated in FIG. 3. A white part indicates "1" and a hatched part indicates "0" in the right-side diagrams of FIG. 4A and FIG. 4B.

The gray-scale code C included in the image signal $S_{disp}$ which has been supplied from the outside is the normal 12-bit (4096-step) gray-scale code as illustrated in FIG. 4A. That is, the weight of each bit is typically twice that of a bit which is lower than the bit concerned by one order. Owing to the above, the widths of the bit planes BP1 to BP12 relating to the respective pieces of gray-scale data c1 to c12 are set at the ratio of 1 (BP1):2 (BP2):4 (BP3):8 (BP4): . . . :1024 (BP11):2048 (BP12) in accordance with the weights of the respective bits.

The bit plane width adjusting section 22 format-converts the 4096-step gray-scale0 code C that includes the 12-bit gray-scale data as mentioned above into the 4096-step gray-scale code B that includes the 13-bit gray-scale data illustrated in FIG. 4B and is the same as the code C in step number. In format conversion, first, the bit plane width adjusting section 22 divides the bit plane BP12 corresponding to the most significant bit c12 in the gray-scale code C (FIG. 4A) into two bit planes (bit planes BP12 and BP13). Then, the bit plane width adjusting section 22 generates three pieces of gray-scale data b11, b12 and b13 for three high-order bits in the gray-scale code B on the basis of the two pieces of gray-scale data c11 and c12 for two high-order bits in the gray-scale code C in association with the division. Specifically, the bit plane width adjusting section 22 processes so as to bring the regions "1" in the bits c11 and c12 near low-order side parts (left side parts) within the regions of the bits c11 and c12 (the bits b13 to b11) as illustrated in FIG. 4A. That is, for example, when the gray-scale code is "2048", "10" (FIG. 4A) of the two high-order bits (c12 and c11) in the gray-scale code C is converted into "011" of the three high-order bits (b13, b12, and b11) (FIG. 4B). The bit plane width adjusting section 22 processes so as to move the position of the region "1" concerned toward its low-order side while maintaining the time width across which "1" is indicated in each code in the above mentioned manner as illustrated in FIG. 4A and FIG. 4B. Owing to the above, it is allowed to facilitate adjustment of each bit plane width which will be described later.

(Correction of Gray-Scale Display)

Next, correction of gray-scale display of each pixel 11 will be described. First, a characteristic of gray-scale display of the pixel 11 observed before correction will be described.

Figure 5:
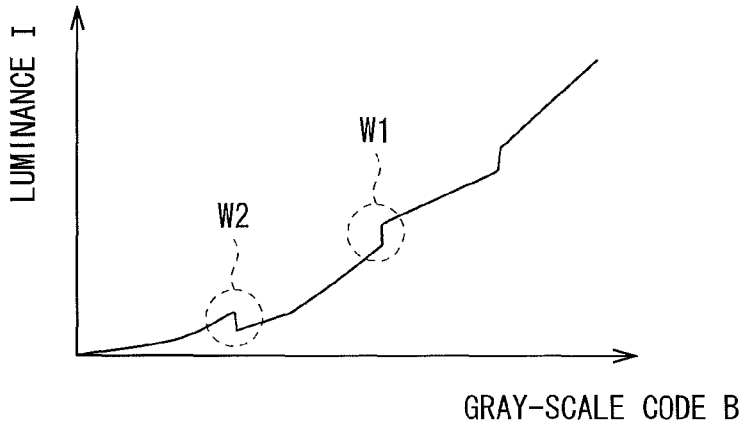
FIG. 5 is a diagram illustrating an example of a gray-scale characteristic of the pixel illustrated in FIG. 1.

FIG. 5 illustrates an example of a characteristic of gray-scale display of the pixel observed before correction. In general, in a relation between the gray-scale code B and the luminance I, it is desirable that the luminance I be smoothly increased monotonously as the gray-scale code B is increased. However, in this example, although the luminance I is increased as the gray-scale code B is increased, the luminance I is greatly increased partially (a part W1) or is decreased partially (a part W2), that is, it is difficult for the pixel to exhibit a smoothly changing characteristic as illustrated in FIG. 5. When an image is displayed using a display device having a characteristic as mentioned above, it is difficult to normally perform gray-scale display and hence the image quality may be reduced.

Figure 6:
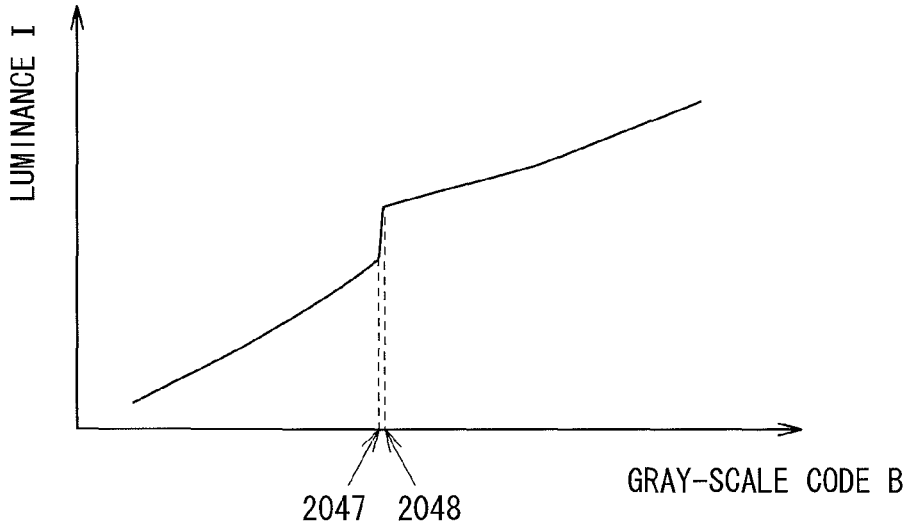
FIG. 6 is a diagram illustrating an example of one part of the gray-scale characteristic illustrated in FIG. 5.

FIG. 6 is an enlarged view of an example of the part W1 in FIG. 5. In this example, the luminance I is greatly increased when the gray-scale code B changes from "2047" to "2048".

Figure 7:
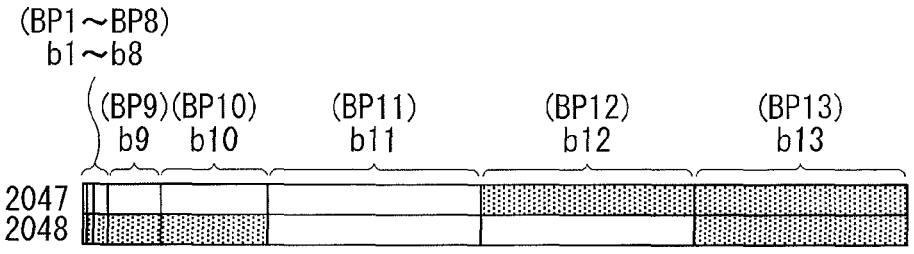
FIG. 7 is a schematic diagram illustrating an example of the gray-scale code relating to the part of the gray-scale characteristic illustrated in FIG. 6.

FIG. 7 illustrates an example of the respective pieces of gray-scale data b1 to b13 when the gray-scale code B indicates "2047" and "2048" together with the bit planes BP. When the gray-scale code B is "2047", the values of the respective pieces of gray-scale data b1 to b11 are "1s" and the values of the respective pieces of gray-scale data b12 and b13 are "0s". On the other hand, when the gray-scale code B is "2048", the values of the respective pieces of gray-scale data b11 and b12 are "1s" and the values of the respective pieces of gray-scale data b1 to b10, and b13 are "0s". When "1" is generated on a high-order side (b12 in this example) by increasing the number of the gray-scale code B by one, discontinuity may occur. That is, this is because since the higher the order of a bit is, the more the width of the corresponding bit plane is increased, influence on the luminance I is increased accordingly. Specifically, for example, when the pixel 11 is configured by a liquid crystal cell, it is difficult for a liquid crystal molecule to rapidly respond to voltage application, and it slowly responds and changes its orientation. Thus, since the timing at which the voltage is applied when the gray-scale code B is "2047" is different from that when the gray-scale code B is "2048", for example, timings at which the liquid crystal molecules fall down are different from each other and hence discontinuity as mentioned above may occur in the luminance.

In the case that the luminance I is greatly increased as the gray-scale code B is increased as described above, the bit plane width adjusting section 22 operates to suppress its steep increase by adjusting the bit plane width as described hereinbelow.

Figure 8:
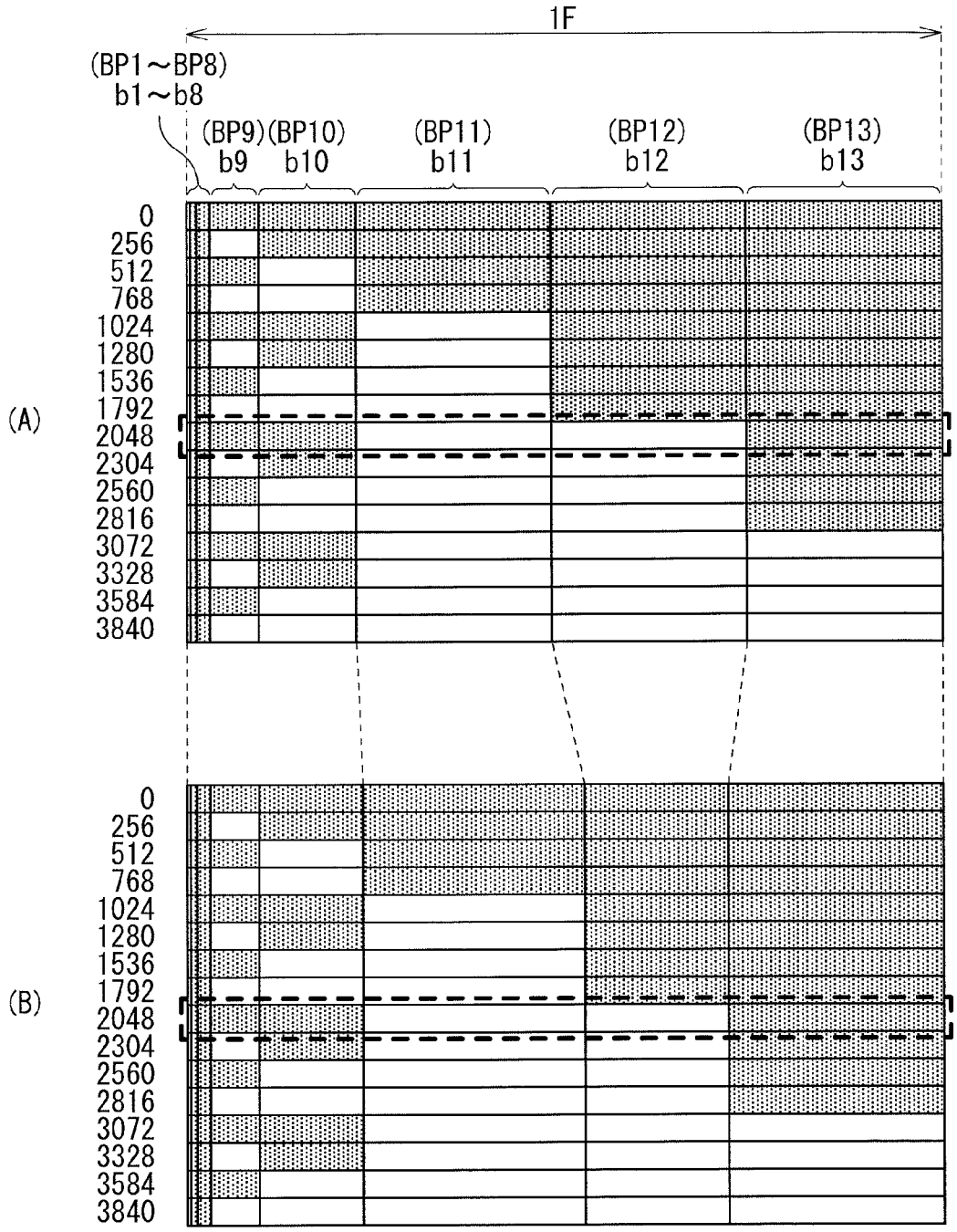
FIG. 8 is a diagram illustrating an example of adjustment of each bit plane width relating to a bit plane width adjusting section illustrated in FIG. 1.

FIG. 8 schematically illustrates an example of adjustment of the bit plane widths by the bit plane width adjusting section 22, in which (A) illustrates an example of each bit plane BP before adjustment and (B) illustrates an example of each bit plane BP after adjustment.

In the examples illustrated in FIG. 6 and FIG. 7, when "1" generates in the gray-scale data b12, the luminance I is greatly increased. In the above mentioned situation, it is allowed to suppress its steep increase by decreasing the width of the bit plane BP12 corresponding to the gray-scale data b12 as illustrated in FIG. 8. In the above mentioned case, the bit plane width adjusting section 22 adjusts the width of each of the bit planes BP1 to BP13 so as to maintain the sum of the widths of the bit planes BP1 to BP13. That is, this is because, in general, the sum of the widths of the bit planes BP1 to BP13 corresponds to the one-frame period (1F) which is determined from the image signal $S_{disp}$ and the synchronous signal $S_{sync}$ that are supplied from the outside as illustrated in FIG. 3 and it is difficult for the display device 1 to change it optionally.

In the display device 1, the 12-bit gray-scale code C is format-converted into the 13-bit gray-scale code B, and bit plane width adjustment is performed on the gray-scale code B so format-converted. That is, in the display device 1, bit plane width adjustment is performed on the bit planes BP11 to BP13 relating to the high-order bits b11 to b13 and having almost the same time width. Owing to the above, since the weight on the most significant bit b13 is halved and the number of bit planes BP to be adjusted is increased as compared with bit plane width adjustment performed on the 12-bit gray-scale code C, adjustment which is higher in degree of freedom is allowed. Specifically, the width of each of the bit planes BP11 to BP13 corresponds to the code width of "1024" in the gray-scale code B as illustrated in FIG. 4B. That is, the display device 1 is allowed to correct the discontinuity that would occur every "1024".

The display device 1 is allowed, for example, to suppress the steep increase of the luminance I illustrated in FIG. 6 by decreasing the width of the bit plane BP12 in the above mentioned manner.

Incidentally, in general, resolution works in adjustment and it may sometimes occur that the above mentioned steep increase is excessively adjusted. Next, correction performed when such a case as mentioned above occurs will be described.

Figures 9, 10:
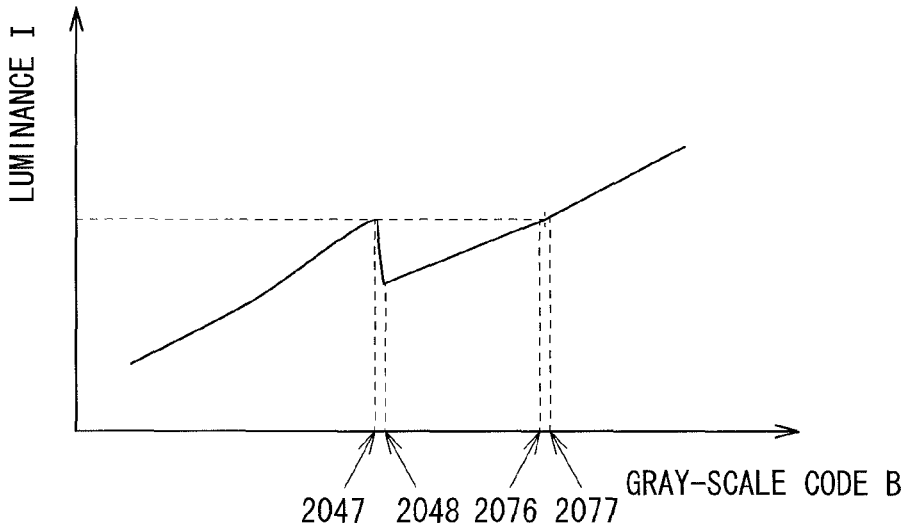
FIG. 9 is a diagram illustrating an example of one part of a gray-scale characteristic.
FIG. 10 is a diagram illustrating an example of a conversion table relating to a gray-scale converting section illustrated in FIG. 1.

FIG. 9 illustrates an example of a relation between the gray-scale code B and the luminance I when the bit plane width has been excessively adjusted. Although the luminance I is greatly increased as the gray-scale code B is increased in the example in FIG. 6, the luminance I is decreased as the gray-scale code B is increased in the example in FIG. 9 in opposition to the above. That is, monotonicity is lost in the characteristic illustrated in FIG. 9. Such a characteristic as mentioned above is exhibited by making the width of the bit plane BP12 narrower than a desired width, for example, when the resolution in bit plane adjustment is not sufficiently high.

In the case that the luminance I is decreased as the gray-scale code B is increased as mentioned above, the gray-scale converting section 23 is allowed to suppress its decrease by performing gray-scale conversion so as to exclude a part of the gray-scale code B. Specifically, in the example illustrated in FIG. 9, the luminance I obtained when the gray-scale code B is within a range from "2048" to "2076" is lower than the luminance I when the gray-scale code is "2047". Thus, it is allowed to obtain the monotonicity as described below by excluding the range from "2048" to "2076" of the gray-scale code B.

Figure 11:
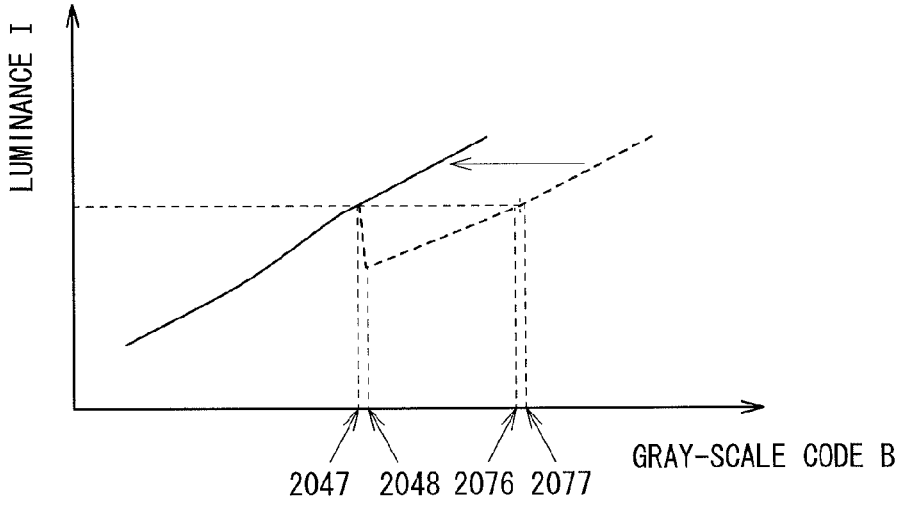
FIG. 11 is a diagram illustrating an example of gray-scale conversion relating to the gray-scale converting section illustrated in FIG. 1.

FIG. 10 illustrates one example of a conversion table T of the gray-scale converting section 23 and FIG. 11 illustrates an example of a gray-scale converting process performed using the conversion table T.

The gray-scale converting section 23 performs gray-scale conversion on the gray-scale code B by using the conversion table T as illustrated, for example, in FIG. 10. In this example, when "2047" has been input as the gray-scale code B, the gray-scale converting section 23 outputs "2047" as it is, while when "2048" has been input as the gray-scale code B, it outputs "2077". That is, the gray-scale converting section 23 skips the gray-code B by excluding the range from "2048" to "2076". Owing to the above, the gray-scale converting section 23 is allowed to grayscale-convert a characteristic indicated by a broken line into a characteristic indicated by a solid line, whereby the luminance I is increased monotonously in accordance with an increase in the gray-scale code B, as illustrated, for example, by FIG. 11.

In the display device 1, it is allowed to improve the discontinuity of the part W1 illustrated in FIG. 5 by bit plane width adjustment (performed by the bit plane width adjusting section 22) and gray-scale conversion (performed by the gray-scale converting section 23) as mentioned above.

Next, correction of the characteristic of the part W2 illustrated in FIG. 5 will be described.

Figure 12:
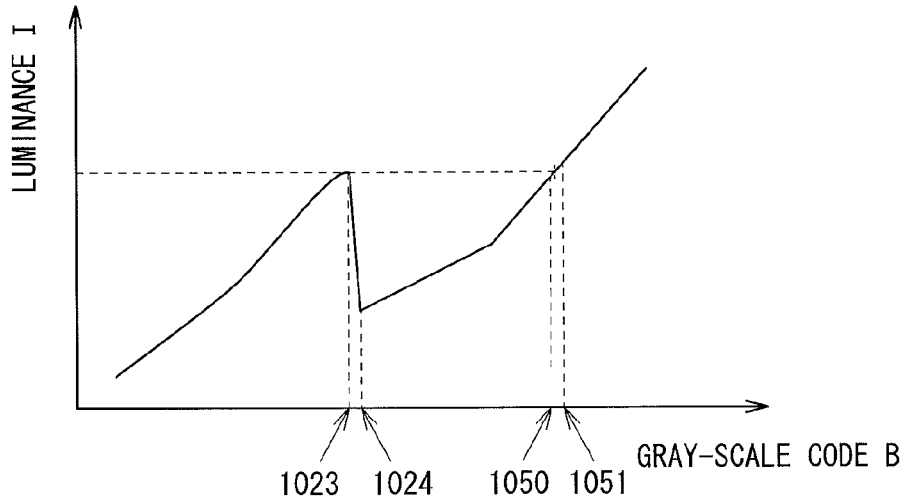
FIG. 12 is a diagram illustrating an example of another part of the gray-scale characteristic illustrated in FIG. 5.

FIG. 12 is an enlarged view of an example of the part W2 illustrated in FIG. 5. In this example, the luminance I is decreased when the gray-scale code B changes from "1023" to "1024". That is, monotonicity is lost in the characteristic illustrated in FIG. 12.

Figure 13:
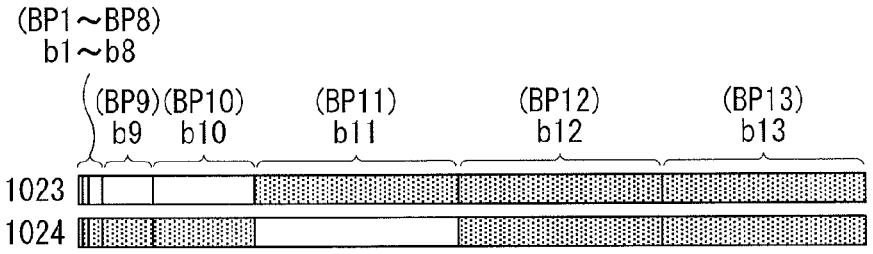
FIG. 13 is a schematic diagram illustrating an example of a gray-scale code relating to another part of the gray-scale characteristic illustrated in FIG. 12.

FIG. 13 is an example of the respective pieces of gray-scale data b1 to b13 illustrated together with the bit planes BP when the gray-scale code B indicates "1023" and "1024". When the gray-scale code B is "1023", the values of the respective pieces of gray-scale data b1 to b10 are "1s" and the values of the respective pieces of gray-scale data b11 to b13 are "0s". On the other hand, when the gray-scale code B is "1024", the value of the gray-scale data b11 is "1" and the values of the respective pieces of gray-scale data b1 to b10, b12, and b13 are "0s". Also in the above mentioned situation, discontinuity occurs in the luminance I by generating "1" on the high-order side (b11 in this example) when the number of the gray-scale code B is increased by one.

Figures 14, 15:
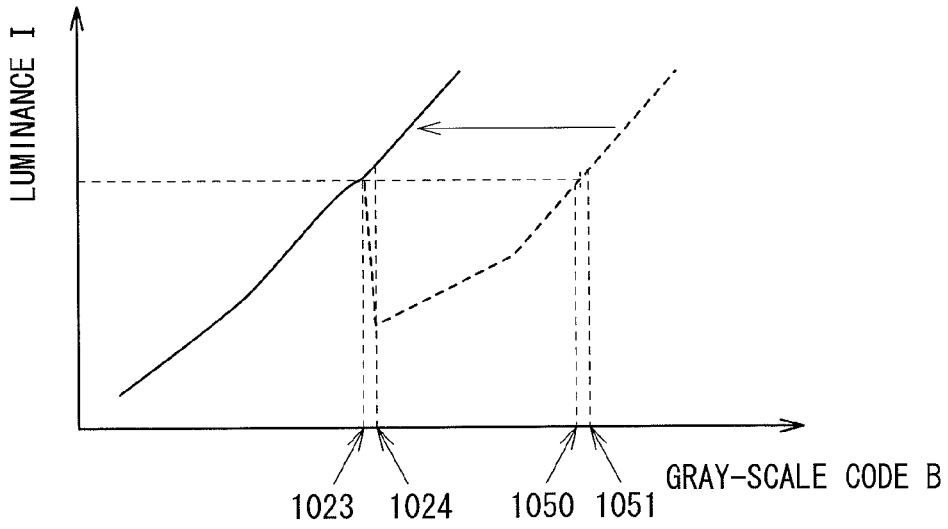
FIG. 14 is another diagram illustrating an example of the conversion table relating to the gray-scale converting section illustrated in FIG. 1.
FIG. 15 is another diagram illustrating an example of the gray-scale conversion relating to the gray-scale converting section illustrated in FIG. 1.

In the above mentioned case, it is allowed to improve the discontinuity by performing the gray-scale converting process using the gray-scale converting section 23 in the same manner as that illustrated in FIG. 10 and FIG. 11. That is, the gray-scale converting section 23 skips the gray-scale code B by excluding the range from "1024" to "1050" as illustrated in FIG. 14, by which the gray-scale converting section 23 is allowed to grayscale-convert a characteristic indicated by a broken line into a characteristic indicated by a solid line as illustrated in FIG. 15, and the luminance I is monotonously increased in accordance with an increase in the gray-scale code B.

In the display device 1, it is allowed to improve the discontinuity of the part W2 illustrated in FIG. 5 by gray-scale conversion (performed by the gray-scale converting section 23) as described above.

[Effects]

Since the bit plane width is adjusted, when the luminance of the pixel greatly changes partially in accordance with a change in the gray-scale code, it is allowed to suppress its increase/decrease to smoothly change the luminance as described above in the present embodiment.

In addition, since the bit plane width is divided, it is allowed to perform adjustment which is higher in degree of freedom in the present embodiment.

Further, since gray-scale conversion is performed so as to exclude the part of the gray-scale code, when the luminance of the pixel does not change monotonously with a change in the gray-scale code, it is allowed to improve the monotonicity to smoothly change the luminance in the present embodiment.

[Modification Example 1-1]

Although only the bit plane BP corresponding to the most significant bit in the gray-scale code B is divided in the above embodiment, the present disclosure is not limited to the above. Alternatively, for example, a bit plane BP corresponding to a bit which is lower than the above may also be divided. Next, an example thereof will be described.

Figure 16:
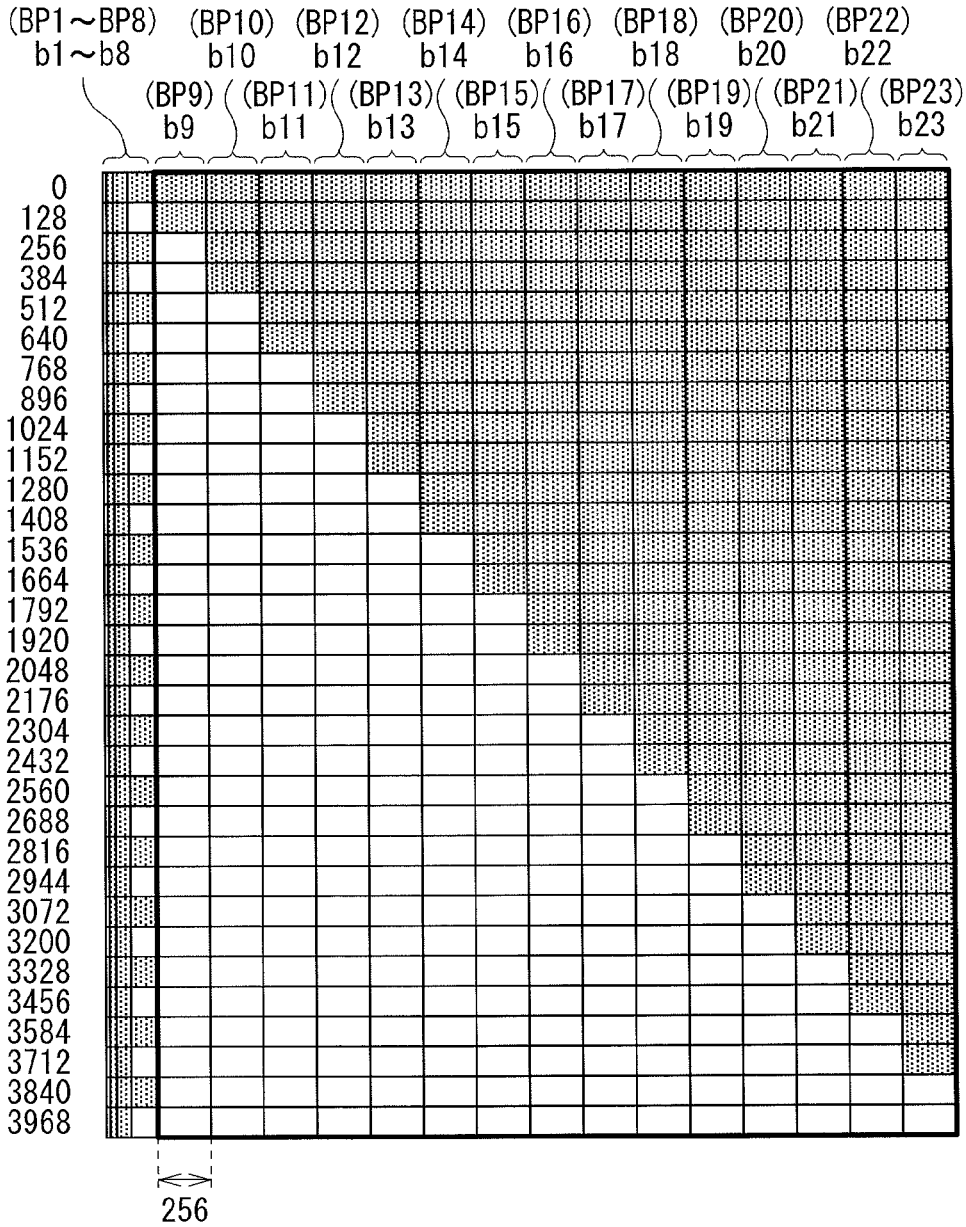
FIG. 16 is a schematic diagram illustrating an example of a gray-scale code according to one modification example.

FIG. 16 illustrates an example of a gray-scale code B according to the present modification example. The gray-scale code B according to the present modification example is a 4096-step gray-scale code that includes 23-bit gray-scale data. This gray-scale code B is obtained by dividing the bit planes BP10 to BP12 corresponding to three high-order bits c10 to c12 in the gray-scale code C (FIG. 4A). That is, the bit plane corresponding to the bit c12 in the gray-scale code C (FIG. 4A) is divided into eight bit planes, the bit plane corresponding to the bit c11 in the gray-scale code C is divided into four bit planes, and the bit plane corresponding to the bit c10 in the gray-scale code C is divided into two bit planes. In the above mentioned case, respective pieces of gray-scale data b9 to b23 for fifteen high-order bits in the gray-scale code B are generated in the same manner as that illustrated in FIG. 4A and FIG. 4B on the basis of respective pieces of gray-scale data c9 to c12 for four high-order bits in the gray-scale code C.

The width of each of the bit planes BP9 to BP23 corresponds to the code width of "256" in the gray-scale code B as illustrated in FIG. 16. That is, in the example illustrated in FIG. 16, it is allowed to correct discontinuity that would occur every "256".

[Modification Example 1-2]

Although the bit plane width adjusting 22 adjusts so as to decrease the bit plane width as illustrated in FIG. 8 when the luminance I is steeply increased (the part W1) in the above mentioned embodiment, the present disclosure is not limited to the above. For example, when the luminance I is decreased (the part W2), the bit plane width adjusting 22 may adjust so as to increase the bit plane width. Specifically, in case of the situation illustrated in FIG. 12, the bit plane width adjusting section 22 is allowed to increase the width of the bit plane BP11 for correction so as to, for example, increase the luminance I monotonously.

[Modification Example 1-3]

Figure 17:
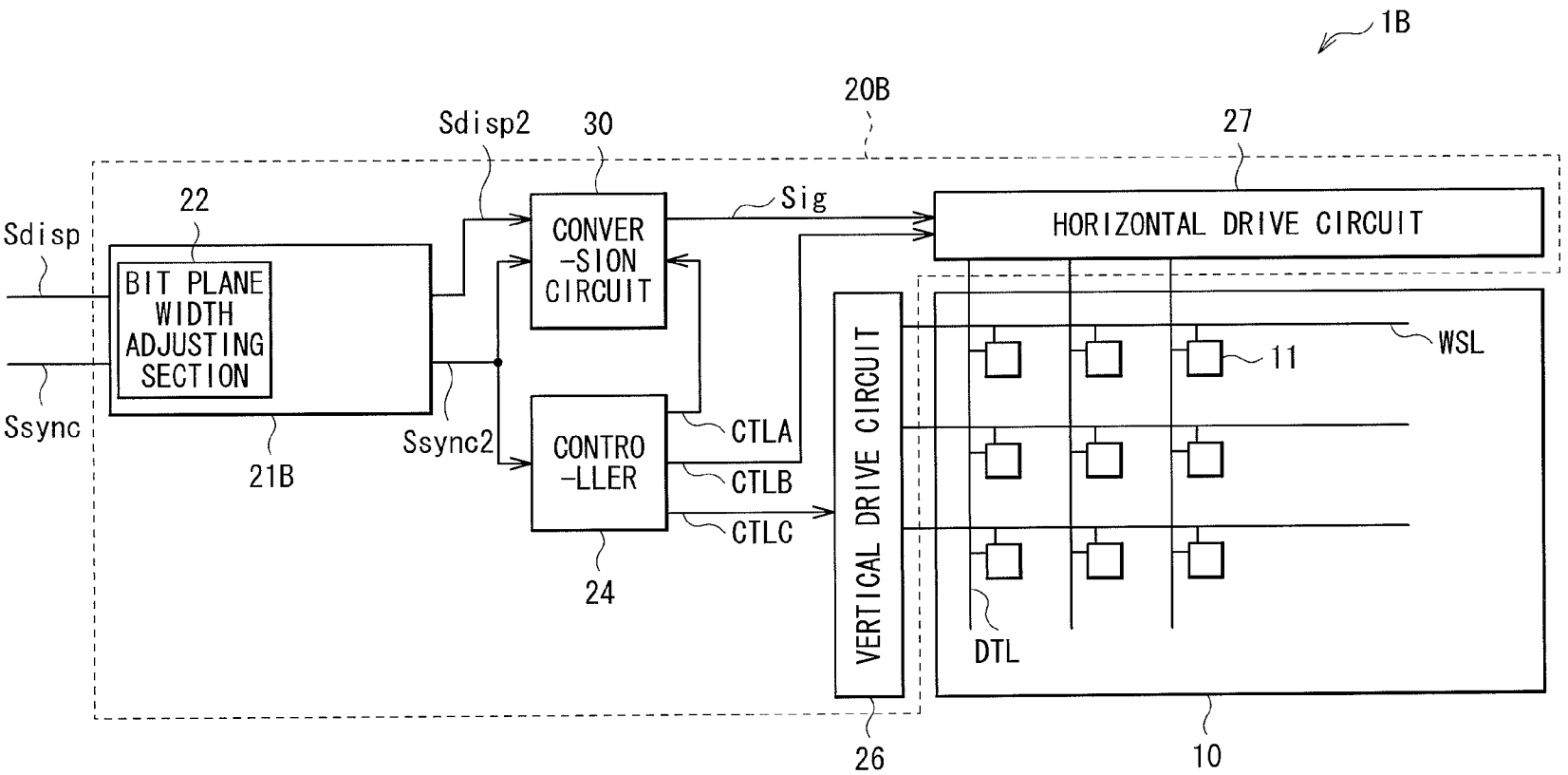
FIG. 17 is a block diagram illustrating one configuration example of a display device according to another modification example.
Figure 18:
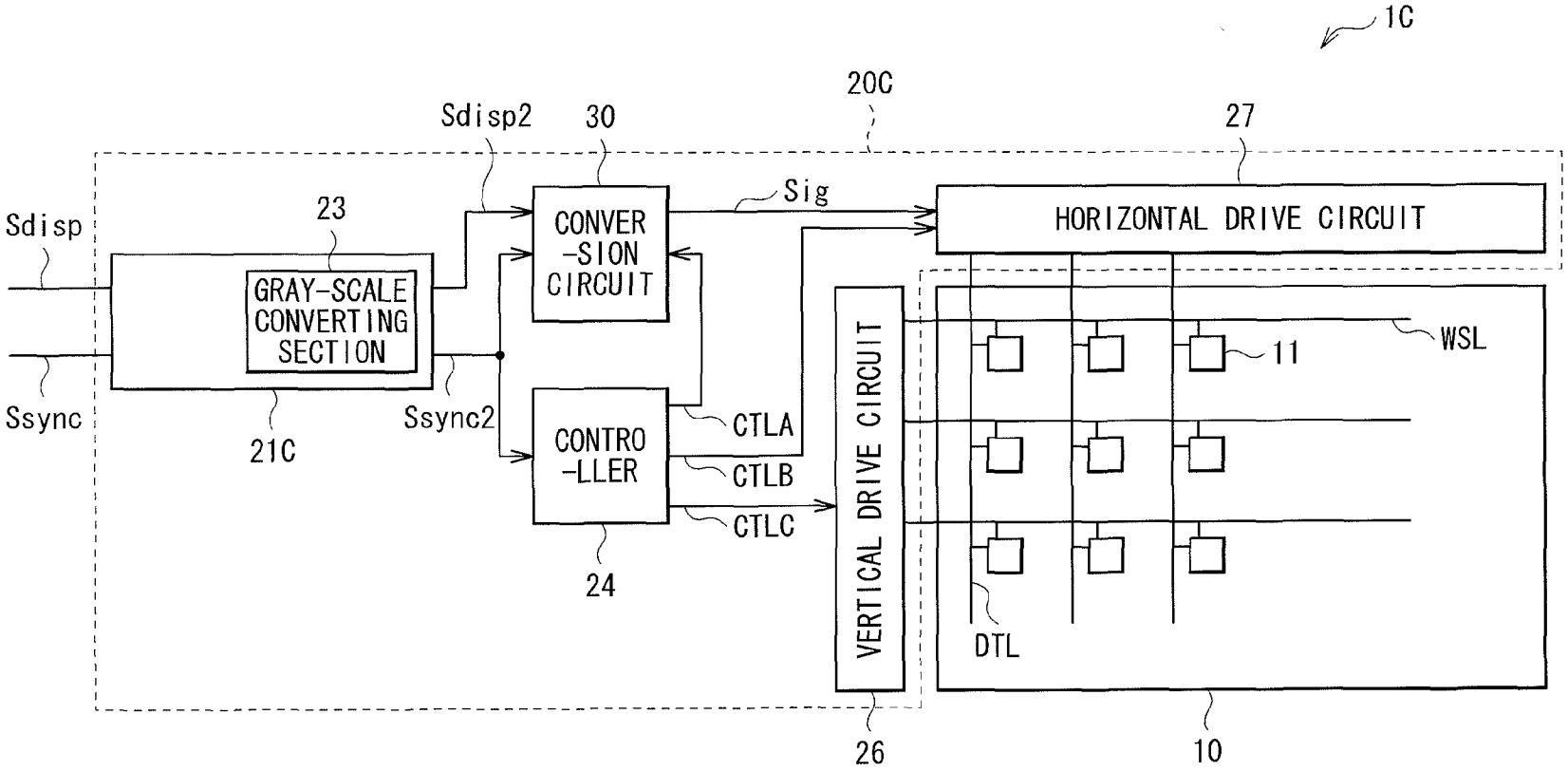
FIG. 18 is a block diagram illustrating one configuration example of a display device according to a further modification example.
Figure 19:
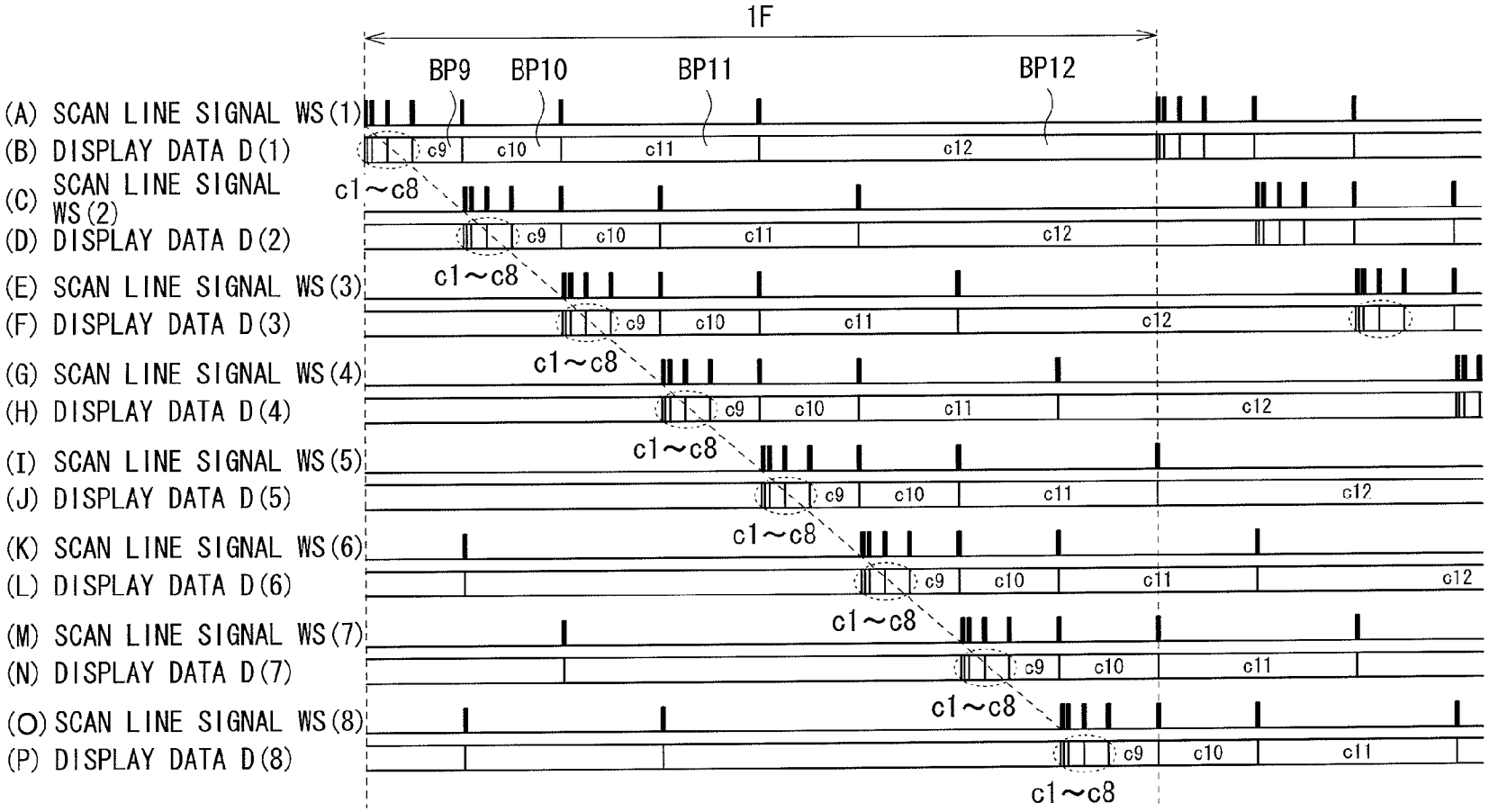
FIG. 19 is a schematic diagram illustrating one operational example of the display device illustrated in FIG. 18.

Although the gray-scale correction circuit 21 includes both the bit plane width adjusting section 22 and the gray-scale converting section 23 in the above embodiment, the present disclosure is not limited to the above. Alternatively, for example, only the bit plane width adjusting section 22 may be included as illustrated in an example in FIG. 17 or only the gray-scale converting section 23 may be included as illustrated in an example in FIG. 18. It is to be noted that when only the gray-scale converting section 23 is included, since format-conversion from the gray-scale code C into the gray-scale code B is not performed and gray-scale conversion is performed directly on the gray-scale code C that remains unconverted by the gray-scale converting section 23, a displaying operation is performed on the basis of the gray-scale code C that includes the respective pieces of 12-bit gray-scale data c1 to c12 in a display device according to this modification example as illustrated in FIG. 19.

Figure 20:
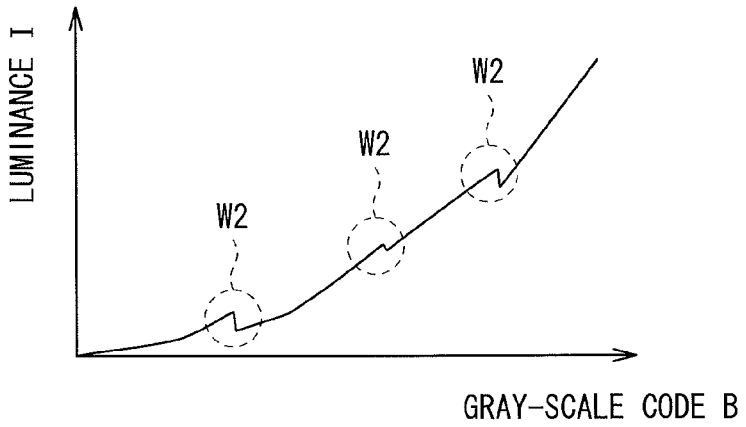
FIG. 20 is a diagram illustrating an example of a gray-scale characteristic of a pixel according to another modification example.

Application of the display device according to this modification example may be allowed, for example, when the major part of discontinuity in the gray-scale characteristic of the pixel 11 corresponds to any one of the parts W1 and W2 illustrated in FIG. 5. That is, for example, when the gray-scale characteristic of the pixel 11 is as illustrated in FIG. 20, for example, application of the configuration only including the gray-scale converting section 23 illustrated in FIG. 18 may be allowed.

<2. Application Examples>

Next, application examples of the display devices described in the above embodiment and modification examples will be described.

Figure 21:
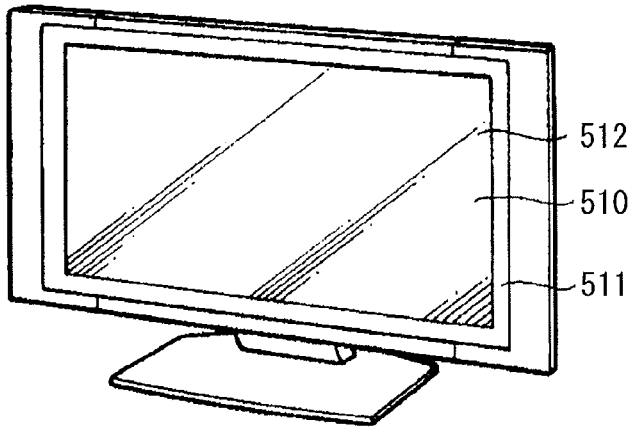
FIG. 21 is a perspective view illustrating an example of an external configuration of a television set to which the display device according to an embodiment is applied.

FIG. 21 illustrates an example of an external appearance of a television set to which the display device according to the above embodiment or the like is to be applied. This television set includes, for example, an image display screen section 510 that includes a front panel 511 and filter glass 512. The image display screen section 510 is configured by the display device according to the above embodiment or the like.

The display device according to the above mentioned embodiment or the like is applicable to any electronic system in all fields such as a digital camera, a notebook personal computer, a portable terminal such as a cell phone or the like, a hand-held game console, a video camera, a projector, and the like, in addition to its application to the television set as mentioned above. In other words, the display device according to the above embodiment or the like is applicable to any electronic system in all fields involving image display.

Although the present technology has been described so far by giving the embodiment and its modification examples, and its application examples to the electronic system, the present technology is not limited to these embodiment, examples and the like and may be modified in a variety of ways.

For example, although the gray-scale correction circuit 21 is disposed on the input side of the peripheral circuit 20 in the above embodiment or the like, the present technology is not limited to the above and, alternatively, for example, it may be included in a part of the horizontal drive circuit 27. In the latter case, for example, it is desirable to supply information on the time widths or the like of the bit planes BP which have been adjusted by the bit plane width adjusting section 22 to, for example, the vertical drive circuit 26, the conversion circuit 30 and the like.

In addition, for example, although the values of the respective bits in the gray-scale code B are written into the respective pixels 11 in order starting from the low-order bit b1 in the above embodiment or the like, the present technology is not limited to the above. Alternatively, for example, the bit values may be written into the pixels starting from the high-order bit b12. Further, the present technology is not limited to sequential writing of the respective bits in the gray-scale code B starting from the low-order or high-order bit as described above and the bit values may be written in order of the bits b23, b21, . . . , b11, b9, b1, b2, . . . , b7, b8, b10, b12, . . . , b20, and b22, for example, in the case illustrated in FIG. 16.

Further, for example, although the time widths of the bit planes BP are set at the ratio of 1:2:4:8: . . . in accordance with the weights of the bits in the above embodiment or the like, the present technology is not limited to the above and the ratio may be slightly changed within a range not affecting the image quality.

Accordingly, it is possible to achieve at least the following configurations from the above-described example embodiments and the modifications of the disclosure.

(1) A display device, including:

a display section including a display pixel;

a driving section driving, at a drive interval that conforms to a weight of each bit in a gray-scale code that includes the bits, the display pixel based on a value of each of the bits; and a correcting section configured to so correct the drive interval, the gray-scale code, or both of the drive interval and the gray-scale code as to change a luminance of the display pixel smoothly.

(2) The display device according to (1), wherein the correcting section corrects one or more of the drive intervals.

(3) The display device according to (2), wherein the correcting section divides the drive interval that corresponds to most significant bit in the gray-scale code, or divides each of the drive intervals that correspond to the respective bits counted from the most significant bit, into a plurality of divided drive intervals, and corrects one or more of the divided drive intervals.

(4) The display device according to (3), wherein the correcting section corrects the gray-scale code by converting the gray-scale code into a gray-scale code that includes bits of the number that is increased by the number of drive intervals increased by the division.

(5) The display device according to (4), wherein the correcting section generates, based on the value of the most significant bit or the values of the bits counted from the most significant bit and on the value of the bit that is lower by one order than the most significant bit or than the bits counted from the most significant bit, values of the bits that correspond to the divided drive intervals in the converted gray-scale code and a value of the bit that is lower by one order than the bits that correspond to the divided drive intervals in the converted gray-scale code.

(6) The display device according to (4) or (5), wherein the correcting section corrects the gray-scale code by converting the converted gray-scale code into a gray-scale code in which a part of the converted gray-scale code is excluded.

(7) The display device according to any one of (2) to (6), wherein the correcting section so performs the correction as to allow sum of the drive intervals to be constant.

(8) The display device according to any one of (2) to (7), wherein the correcting section corrects the gray-scale code by converting the gray-scale code into a gray-scale code in which a part of the gray-scale code is excluded.

(9) The display device according to (1), wherein the correcting section divides the drive interval that corresponds to most significant bit in the gray-scale code, or divides each of the drive intervals that correspond to the respective bits counted from the most significant bit, into a plurality of divided drive intervals, and the correcting section corrects the gray-scale code by converting the gray-scale code into a gray-scale code that includes bits of the number that is increased by the number of drive intervals increased by the division.

(10) The display device according to (1), wherein the correcting section corrects the gray-scale code by converting the gray-scale code into a gray-scale code in which a part of the gray-scale code is excluded.

(11) A display method, including:

performing display by driving a display pixel at a drive interval that conforms to a weight of each bit in a gray-scale code that includes the bits; and so correcting the drive interval, the gray-scale code, or both of the drive interval and the gray-scale code as to change a luminance of the display pixel smoothly.

(12) An electronic system, including:

a display device; and a control section performing operation control that utilizes the display device, wherein the display device includes a display section including a display pixel, a driving section driving, at a drive interval that conforms to a weight of each bit in a gray-scale code that includes the bits, the display pixel based on a value of each of the bits, and a correcting section configured to so correct the drive interval, the gray-scale code, or both of the drive interval and the gray-scale code as to change a luminance of the display pixel smoothly.

It is to be noted that any combinations of (2) to (10) directed to the display device are applicable also to each of (11) directed to the display method and (12) directed to the electronic system unless any contradictions occur. Such combinations are considered also as preferred combinations of example embodiments according to the technology.

The disclosure contains subject matter related to that disclosed in Japanese Priority Patent Application JP 2011-207140 filed in the Japan Patent Office on Sep. 22, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device, comprising:

a display section including at least one display pixel;

a driving section configured to drive the display section at drive intervals, each drive interval time width conforms to a weight of each bit in a gray-scale code, wherein the gray-scale code corresponds to a drive voltage of a pixel; and a correcting section configured to (a) divide a drive interval of one or more most significant bits into a plurality of divided drive intervals; and (b) convert a first gray-scale code of the plurality of drive intervals and divided drive intervals which has a discontinuity with respect to luminance into a second gray-scale code which is monotonously continuous with respect to luminance and which has a range of gray-scale data of the first gray-scale code excluded from the second gray-scale code at the point of discontinuity.

2. The display device according to claim 1, wherein the correcting section is configured to perform the division on more than one of the drive intervals.

3. The display device according to claim 2, wherein the correcting section is configured to: perform the division on the drive interval that corresponds to a most significant bit in the first gray-scale code of the first bit length, or perform the division on the drive interval that corresponds to a bit counted by a predetermined amount from the most significant bit.

4. The display device according to claim 3, wherein the correcting section is configured to convert the first gray-scale code of the first bit length into the second gray-scale code of the second bit length that includes bits of the first bit length in addition to a number of bits that is increased by a number of drive intervals increased by the division.

5. The display device according to claim 4, wherein the correcting section is configured to generate values of the bits that correspond to the divided drive intervals and a value of the bit that is lower by one order than the bits that correspond to the divided drive intervals.

6. The display device according to claim 2, wherein the correcting section is configured to maintain a sum of the drive intervals to be constant.

7. The display device according to claim 1, wherein:

the correcting section is configured to divide the drive interval that corresponds to a most significant bit in the first gray-scale code of the first bit length, or divide the drive interval that corresponds to a bit counted from the most significant bit, and the correcting section is configured to convert the first gray-scale code of the first bit length into the second gray-scale code of the second bit length, the second bit length being greater than the first bit length by a number of drive intervals increased by the division.

8. The display device according to claim 1, wherein the exclusion of the range of the gray-scale data from the second gray-scale code effectively removes a discontinuity in luminance that is associated with the second gray-scale code.

9. A display method, comprising:

driving a display pixel at drive intervals that conforms to a weight of each bit in a gray-scale code, wherein the gray-scale code corresponds to a drive voltage of a pixel;

dividing the drive intervals of one or more most significant bits into a plurality of divided drive intervals; and converting a first gray-scale code of the plurality of drive intervals and divided drive intervals into a second gray-scale code which is monotonously continuous with respect to luminance and which has a range of gray-scale data excluded from the second gray-scale code at the point of discontinuity.

10. The display method according to claim 9, wherein the exclusion of the range of the gray-scale data from the second gray-scale code effectively removes a discontinuity in luminance that is associated with the second gray-scale code.

11. An electronic system, comprising:

a display device; and a control section that controls the display device, wherein, the display device includes:

(i) a display section including at least one display pixel, (ii) a driving section configured to drive the display section at drive intervals that conforms to a weight of each bit in a gray-scale code, wherein the gray-scale code corresponds to a drive voltage of a pixel; and (iii) a correcting section configured to:

(a) divide a drive interval of one or more most significant bits into a plurality of divided drive intervals and (b) convert a first gray-scale code of the plurality of drive intervals and divided drive intervals into a second gray-scale code which is monotonously continuous with respect to luminance and which has a range of gray-scale data excluded from the second gray-scale code at the point of discontinuity.

12. The electronic system according to claim 11, wherein the exclusion of the range of the gray-scale data from the second gray-scale code effectively removes a discontinuity in luminance that is associated with the second gray-scale code.

* * * * *